United States Patent [19]

Kino

[11] Patent Number: 4,547,172

[45] Date of Patent: Oct. 15, 1985

[54] SOUND PRODUCING TOY

[75] Inventor: Moriya Kino, Yokohama, Japan

[73] Assignee: Royal Co., Ltd., Tokyo, Japan

[21] Appl. No.: 536,435

[22] Filed: Sep. 27, 1983

[51] Int. Cl.[4] ..... A63H 5/00

[52] U.S. Cl. ..... 446/421

[58] Field of Search ..... 446/418, 419, 420, 421, 446/422, 227, 121, 85, 87; 403/349, 446

[56] References Cited

U.S. PATENT DOCUMENTS

| | | | |
|---|---|---|---|
| 1,383,283 | 7/1921 | Blake | 446/421 |
| 2,331,861 | 10/1943 | Smith | 403/349 X |
| 2,442,680 | 6/1948 | Ewald | 446/421 |
| 2,826,000 | 3/1958 | Fishman et al. | 446/121 X |

*Primary Examiner*—Mickey Yu

*Attorney, Agent, or Firm*—Birch, Stewart, Kolasch & Birch

[57] ABSTRACT

The disclosure relates to a sound producing toy for babies or little children, having a housing for accommodating a sound producing mechanism therein. The housing includes a cylindrical hollow drum having a thin wall, and upper and lower caps respectively secured to the opposite end portions of the drum. The opposite end portions of the drum are respectively fixedly forced into annular grooves which are formed in peripheral side walls of the upper and lower caps, so that the strength or rigidity of the drum is reinforced by the peripheral side walls of the upper and lower caps.

4 Claims, 8 Drawing Figures

SOUND PRODUCING TOY

BACKGROUND OF THE INVENTION

The present invention generally relates to a toy for babies or little children, and more particularly to a sound producing toy which has a housing for accommodating a sound producing mechanism therein and a grip member secured to the housing.

Conventionally, there has been provided a sound producing toy of the above type, in which the housing comprises a cylindrical hollow drum having a thin wall, and upper and lower caps respectively secured to the opposite end portions of the drum. The upper and lower caps respectively have peripheral side walls, annular faces of which are caused to adhere to corresponding annular end faces of the drum. The grip member has, at an upper end thereof, a screw which is threaded into a threaded hole formed in a bottom wall of the lower cap.

The conventional toy as described above, however, has a disadvantage in that since the drum has a thin wall, the drum is so weak that the drum is readily deformed or broken by pressure.

It should be noted that it is practically impossible to enlarge the wall-thickness of the drum in order to make the drum to have the strength or rigidity sufficient to resist the pressure since the toy for babies or little children of this type should be as light as possible in weight and the sound generated by the sound generating mechanism accommodated in the housing should be efficiently transferred outwardly. It should be also noted that according to the conventional toy as described above, since the body and the upper and lower caps are caused to adhere to each other such that the end faces thereof only contact each other face to face, the upper and lower caps do not efficiently serve to improve the rigidity of the drum, and the end faces of the drum readily and partially separates from the end of faces of the upper and lower caps due to the strong pressure.

SUMMARY OF THE INVENTION

It is therefore an essential object of the present invention to provide a sound producing toy of the above type, the housing of which has a housing including a cylindrical drum which is improved in the strength or rigidity thereof, without enlarging the wall-thickness thereof.

Another object of the present invention is to provide a sound producing toy of the above type in which the drum is strengthened by the improvement of the construction for connecting the drum with the upper and lower caps.

A further object of the present invention is to provide a sound producing toy of the above type which is simple in construction for connecting the drum with the upper and lower caps, and readily manufactured at low cost.

In accomplishing these and other objects, according to the present invention, there is provided a sound producing toy comprising a housing for accommodating a sound producing mechanism therein and a grip member which is secured to said housing, said housing comprises a cylindrical hollow drum having opposite end openings; an upper cap which has a peripheral side wall and bottom wall, said peripheral side wall being provided therein with an annular groove which opens toward an annular end face thereof, an upper end portion of said drum being fixedly forced into said groove; and a lower cap which has a peripheral side wall and bottom wall, the peripheral side wall of said lower cap having therein an annular groove which opens toward an annular end face thereof, a lower end portion of said drum being fixedly forced into the groove of said lower cap, said bottom wall being secured to the upper end of said grip member.

According to the present invention, the upper and lower end portions of the drum are stably and rigidly held by the side walls of the upper and lower caps, so that the entire drum including the intermediate part thereof can be reinforced by the side walls of the upper and lower caps, and the upper and lower end portions of the drum can be prevented from readily separating from the upper and lower caps due to the strong pressure. Further, according to the present invention, the reinforcement of the drum can be accomplished by such a simple construction in that the upper and lower portions of the drum are fixedly forced into the grooves of the upper and lower caps.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted that like parts are designated by like reference numerals and symbols throughout several views of the accompanying drawings.

DETAILED DESCRIPTION OF THE INVENTION

Figure 1:
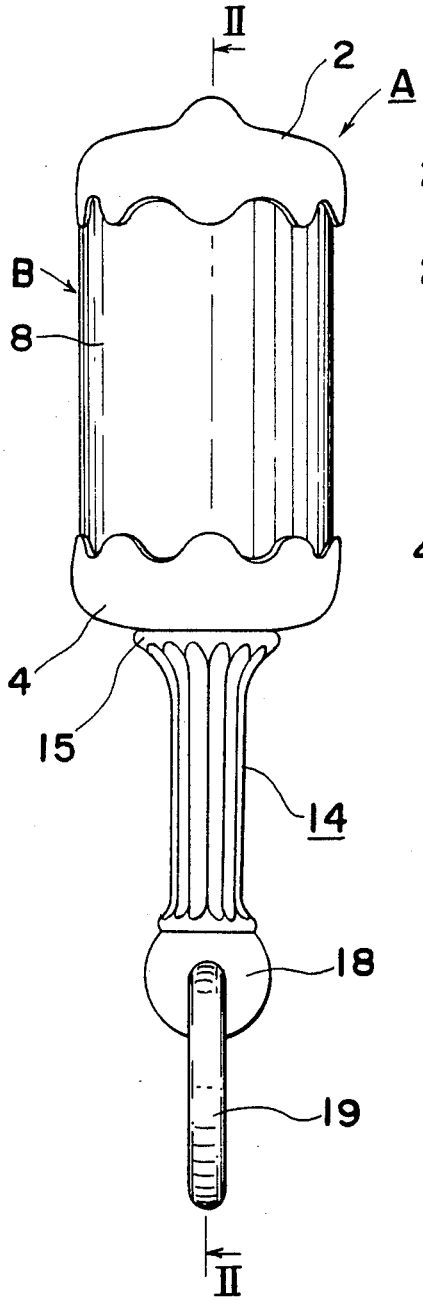
FIG. 1 is a front elevational view of a sound producing toy according to one preferred embodiment of the present invention.
Figure 2:
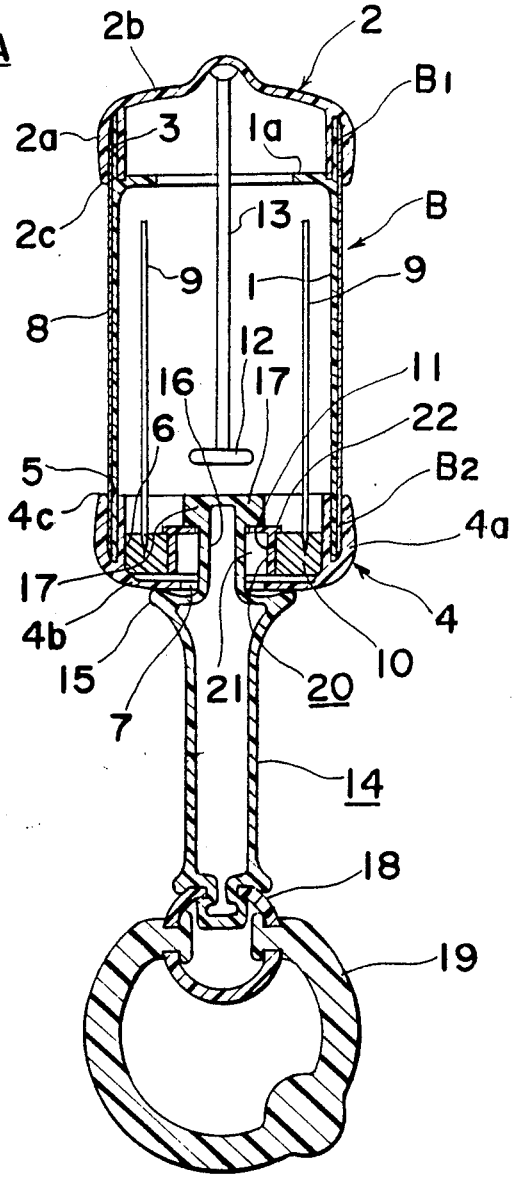
FIG. 2 is a sectional view of the toy taken along a line II—II in FIG. 1.
Figure 3:
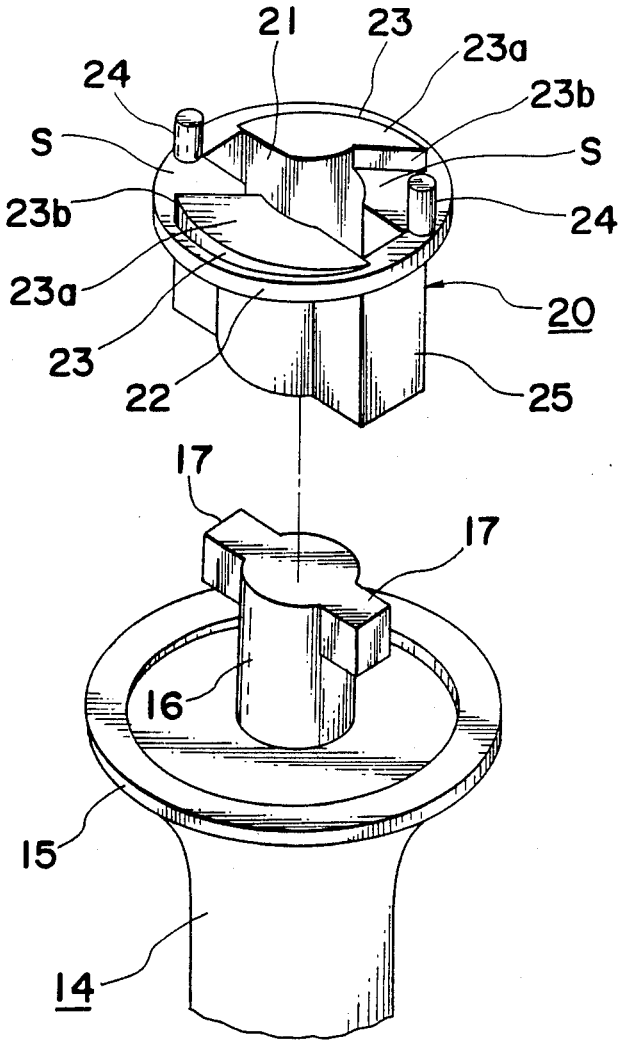
FIG. 3 is a partial view showing an essential part of the toy shown in FIGS. 1 and 2.
Figure 4:
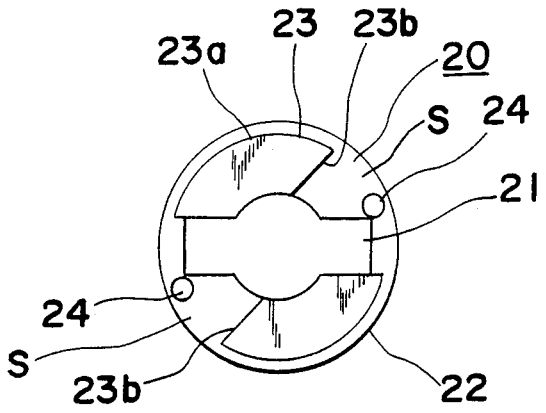
FIGS. 4, 5, 6 and 7 are, respectively, a top plan view, a front elevational view, a right hand side view and a bottom view of a grip holding member shown in FIGS. 1 to 3.
Figure 5:
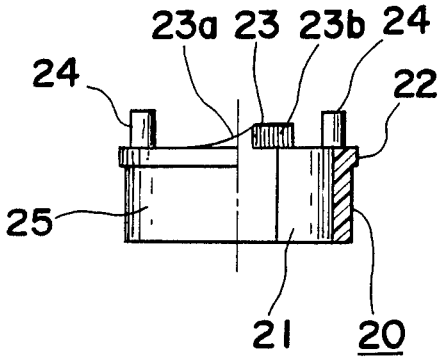
Figure 6:
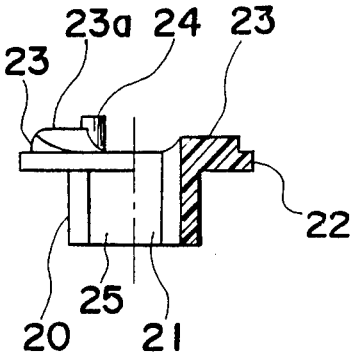
Figure 7:
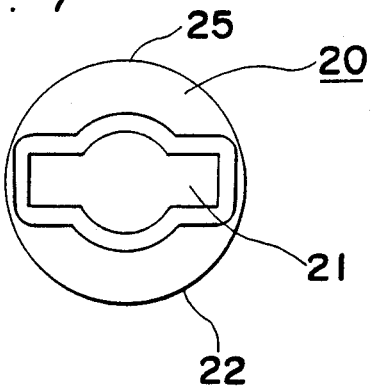

Referring to FIGS. 1 to 7, the sound producing toy according to one preferred embodiment of the present invention comprises a housing A for accommodating a sound producing mechanism therein and grip member 14 which is secured to the housing A.

The housing A comprises a cylindrical hollow drum B having a thin wall and opposite end openings, and upper and lower caps 2 and 4 respectively secured to the opposite end portions $B_1$ and $B_2$ of the drum B. These elements B, 2 and 4 are preferably formed of injection moldings.

The drum B comprises a cylindrical body 1 provided, at the upper end portion thereof, with an annular inner rib 1*a* as a reinforcement member inwardly extending from an inner surface thereof, and a film-like thin decorative outer sleeve 8 surrounding the body 1. The decorative sleeve 8 is generally made of a paper sheet or synthetic resin film, on an outer surface of which, some pattern or picture is illustrate. The sleeve 8 may be also molded integrally with the body 1 with an injection molding.

The upper and lower caps 2 and 4 are generally of similar shape to each other and respectively comprise bottom walls 2*b* and 4*b*, and peripheral side walls 2*a* and 4*a*. The side walls 2*a* and 4*a* respectively are provided therein with annular grooves 3 and 5 which open toward corresponding annular end faces 2*c* and 4*c* thereof. The upper and lower end portions of the drum A are respectively inserted or forced into the grooves 3 and 5 and are caused to adhere to said annular grooves 3 and 5. Therefore, the upper and lower end portions of the drum B are stably and rigidly held by the side walls 2*a* and 4*a* of the upper and lower caps 2 and 4. Thus, the entire drum B including the intermediate part thereof can be reinforced by the side walls 2*a* and 4*b* of the upper and lower caps 2 and 4, and the upper and lower end portions of the drum B can be prevented from being readily separated from the upper and lower caps 2 and 4 due to the strong pressure.

The sound producing mechanism comprises a hammer 12 hanging from the central portion of the bottom wall 2*b* of the upper cap 2 by means of a flexible wire 13, and a plurality of music wires 9, i.e., piano wires, having different lengths, arranged in a circle at equal intervals along the inner surface of the cylindrical body 1. The music wires 9 are secured at the lower ends thereof to a wire holding plate 10 which is made of, for example, a chip board of wood and is fixedly forced into the lower cap 4 so that the music wires 9 respectively extend in the axial direction of the cylindrical body 1 so as to surround the hammer 12 and the flexible wire 13. Therefore, when the housing is swung, the flexible wire 13 is also swung with respect to the housing A so that the hammer 12 strikes the music wires 9 to produce the enjoyable sound.

The grip member 14 has an upper end portion, to be secured to the lower cap 4, including a flange 15, and a shaft 16 upwardly extending from a central portion of the flange 15 and provided with a pair of protrusions 17 which radially extend in directions opposite to each other from an upper end portion of the shaft 16. In addition, the grip member 14 is provided, at the lower end portion thereof, a ring 19 via a spherical connecting member 18. The ring 19 has a diameter sufficiently larger than the size of mouths of babies or little children in order to prevent them from carelessly inserting the lower end portion of the grip member 14 into their mouths.

Meanwhile, a grip holding member 20 is fixedly forced into a central passage 11 of the wire holding plate 10. The grip holding member 20 comprises a body 25, and a flange 22 formed at an upper end of the body 25. A passage 21 axially extends through the body 25 and the flange 22 to receive the shaft 16 of the grip member 14. The flange 22 has, thereon, a pair of guide projections 23 which are placed at the opposite sides with respect to the passage 21 and respectively have inclined faces 23*a* slightly rising from an upper face of the flange 22 along one circumferential direction and end faces 23*b* perpendicular to the upper face, and a pair of studs 24 which are spaced from the corresponding end faces 23*b* of the guide projections 23. Accordingly, in order to secure the grip member 14 to the lower cap 4, the shaft 16 of the grip member 14 is first inserted into the lower cap 4 through a central opening 7, formed in the bottom wall 4*b* of the lower cap 4, and the passage 21 of the grip holding member 20, with the flange 15 of the grip member 16 contacting an outer face of the bottom wall 4*b* of the lower cap 4. Subsequently, the grip member 14 is rotated with respect to the lower cap 4, i.e., the housing A, so that the pair of protrusions 17 resiliently ride over the inclined faces 23*a* of the guide projections 23 to fall down into the spaces S formed between the corresponding end faces 23*b* of the guide projections 23 and the studs 24. In the state that the grip member 14 is secured to the housing A, as described above, the grip member 14 can not rotate with respect to the housing A since the protrusions 17 placed in the spaces S are locked by the end faces 23*b* and the studs 24. Thus, the grip member 14 is stably secured to the housing A.

Figure 8:
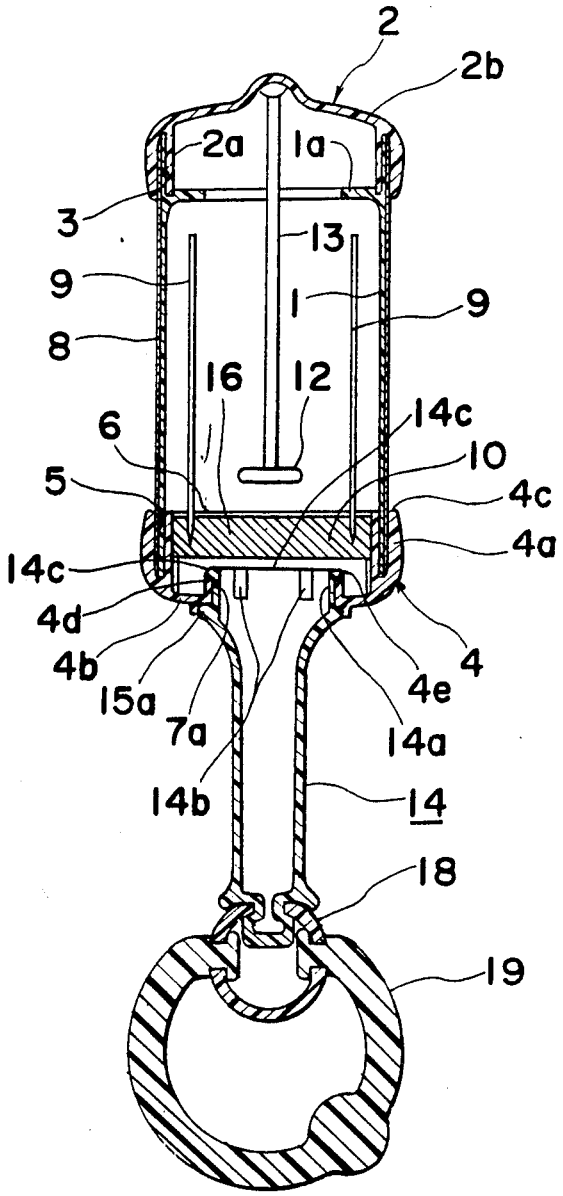
FIG. 8 is a sectional view of a toy according to a modification of the present invention.

Referring now to a modification shown in FIG. 8, the construction for securing the grip holding member 14 to the housing A is simplified as compared with the first embodiment of the present invention. The grip holding member 14 described as employed in the first embodiment has been omitted in this modification. The bottom wall 4*b* of the lower cap 4 has an inner cylindrical wall 4*d* including a passage 7*a* axially extending therethrough. The upper end portion of the grip member 14 comprises a sleeve portion 14*a* which has an end opening, a plurality of slits 14*b* axially extending and facing a peripheral end face 14*d* thereof, a retaining portion 14*c* outwardly protruding from the end portion thereof, and a small flange 15*a* outwardly protruding from the base portion thereof. Therefore, the grip member 14 is secured to the lower cap 4, i.e., the housing A, such that the sleeve portion 14*a* of the grip member 14 is resiliently forced into the lower cap 4 through the passage 7*a* of the lower cap 4, with the flange 15*a* contacting an outer face of the bottom wall 4*b* of the lower cap 4, so that the retaining portion 14*c* is engaged with an end face 4*e* of the inner wall 4*d* of the lower cap 4. In order to ensure more rigid connection between the inner wall 4*d* of the lower cap 4 and the sleeve portion 14*a* of the grip member 14, an inner surface of the inner wall 4*d* is preferably caused to fixedly adhere to an outer surface of the sleeve portion 14*a*.

Although the present invention has been fully described by way of example with reference to the accompanying drawings, it is to be noted here that various changes and modifications will be apparent to those skilled in the art. For instance, the sound producing mechanism including the hammer 12 and the music wires 9 as described above may be replaced by another mechanism. Further, the wire holding plate 10 and the grip holding member 20 in the first embodiment may be made integrally with each other with an injection molding. Therefore, unless otherwise such changes and modifications depart from the scope of the present invention, they should be construed as included therein.

What is claimed is:

1. A sound producing toy comprising a housing for accommodating a sound producing mechanism therein and a grip member which is secured to said housing, said housing comprises:

a cylindrical hollow drum having opposite end openings;

an upper cap including a peripheral side wall and bottom wall, said peripheral side wall being provided therein with an annular groove opening toward an annular end face thereof, an upper end portion of said drum being fixedly forced into said groove;

an annular rib inwardly extending from an inner surface of said drum at a position adjacent to said upper cap for reinforcing said drum;

a lower cap including a peripheral side wall and bottom wall, the peripheral side wall of said lower cap having therein an annular groove opening toward an annular end face thereof, a lower end portion of said drum being fixedly forced into the groove of said lower cap, said bottom wall being secured to the upper end of said grip member;

a wire holding plate fixed to the peripheral side wall of said lower cap and overlapping with said groove in said lower cap for reinforcing the lower end portion of the drum.

2. A sound producing toy as claimed in claim 1, which further comprises a grip holding member which is fixed in said lower cap and has a passage axially extending therethrough, a pair of guide projections which are formed on an upper face thereof at the opposite sides with respect to said passage and respectively have inclined faces slightly rising from said upper face along one circumferential direction and end faces perpendicular to said upper face, and a pair of studs which are respectively formed on said upper face adjacent to the corresponding end faces of said guide projections;

the upper end portion of said grip member having a flange, and a shaft upwardly extending from a central portion of said flange and provided with a pair of protrusions which radially extend in directions opposite to each other from an upper end portion of said shaft;

the bottom wall of said lower cap having a central opening;

whereby the grip member is secured to said lower cap such that the shaft of said grip member is inserted into said lower cap through the central opening of said lower cap and the passage of said grip holding member, with said flange of said grip member contacting an outer face of the bottom wall of said lower cap, to be rotated so that said pair of protrusions resiliently ride over the inclined faces of said guide projections to fall down into spaces formed between the corresponding end faces of said guide projections and said studs.

3. A sound producing toy as claimed in claim 1, wherein the bottom wall of said lower cap has an inner cylindrical wall having a passage axially extending therethrough, the upper end portion of said grip member comprising a sleeve portion which has an end opening, a plurality of slits axially extending and facing a peripheral end face thereof, a retaining portion outwardly protruding from the end portion thereof, and a flange outwardly protruding from the base portion thereof, whereby said grip member is secured to said lower cap such that the sleeve portion of said grip member is resiliently forced into said lower cap through the passage of said lower cap, with said flange contacting an outer face of the bottom wall of said lower cap, so that said retaining portion is engaged with an end face of the inner wall of said lower cap.

4. A sound producing toy as claimed in claim 3, wherein an inner surface of the inner wall of said lower cap is caused to fixedly adhere to an outer surface of the sleeve portion of said grip holding member.

* * * * *